United States Patent [19]

Andersson et al.

[11] Patent Number: 4,807,532

[45] Date of Patent: Feb. 28, 1989

[54] BASE BLEED UNIT

[76] Inventors: Kurt G. Andersson, Pudelgränd 10, Farsta, Sweden, S-12362; Nils-Erik Gunners, Furudalsvagen 10, Västerhaninge, Sweden, S-13700; Yngve L. Nilsson, Mariefredsvägen 2C, Strängnäs, Sweden, S-15200

[21] Appl. No.: 96,631

[22] Filed: Sep. 2, 1987

[30] Foreign Application Priority Data

Sep. 5, 1986 [SE] Sweden ..... 8603737

[51] Int. Cl.[4] ..... F42B 13/02

[52] U.S. Cl. ..... 102/490; 102/380; 102/501

[58] Field of Search ..... 102/202, 374, 376, 490, 102/501, 513, 380

[56] References Cited

U.S. PATENT DOCUMENTS

| | | | |
|---|---|---|---|
| 3,143,853 | 8/1964 | Sobey | 60/256 |
| 4,213,393 | 7/1980 | Gunners et al. | 102/380 |
| 4,397,240 | 8/1983 | Rottenberg et al. | 102/376 |
| 4,691,633 | 8/1987 | Godfun et al. | 102/202 |

FOREIGN PATENT DOCUMENTS

| | | | |
|---|---|---|---|
| 3437250 | 4/1986 | Fed. Rep. of Germany | 102/380 |
| 71043 | 1/1927 | Japan | 102/490 |
| 1138192 | 12/1968 | United Kingdom | 102/380 |
| WO86/05581 | 9/1986 | World Int. Prop. O. | 102/202 |

*Primary Examiner*—Harold J. Tudor
*Attorney, Agent, or Firm*—Holman & Stern

[57] ABSTRACT

A base bleed unit arranged to increase the range of fire or to reduce the time of flight for shells and projectiles includes a housing (1) surrounding a fuel charge (6) and associated igniter (4), extending from the rear portion of a projectile body (2) and including at least one outlet nozzle (5,5',5'') for combustion gases, which by means of a mass flow, and possibly combustion adjacent to the base plane, reduce existing base drag. According to an embodiment of the invention, the housing (1) comprises a caseshaped member 1 attachable against a projectile body (2), having at least one igniter (4) arranged adjacent to an internal plane of a restricting wall surface at the housing (1), located in an opposed relationship to the portion of the housing (1) attachable against a projectile body (2). The combustion flame of the igniter (4) is hereby maintained directed towards the fuel charge (6) and away from the outlet nozzle/nozzles (5, 5',5''). Advantageously, a number of outlet nozzles (5, 5', 5'') are used, arranged spaced in an annular relationship to each other, and preferably inclined towards the outer peripheral portion of the restricting wall surface. A number of igniters (4) are advantageously used, located in recesses or blind holes taken up by the inside plane of the restricing wall surface. It is further advantageous to arrange the open portion of each igniter (4) partly covered by a covering means, thus accomplishing a reduced outlet area. According to a second embodiment, the housing (1) may also be formed by attachment of a bottom member to a projectile body (2) having a rearwardly open projectile extension, said bottom member including one or a number of igniters (4).

26 Claims, 2 Drawing Sheets

BASE BLEED UNIT

TECHNICAL FIELD

The present invention relates to a base bleed unit, arranged to increase the range of fire or decrease the time of flight for shells and projectiles.

BACKGROUND ART

It is previously known to increase the range of fire for artillery shells, and also to decrease the time of flight for anti-aircraft and armour-piercing shells, by generation of a mass flow in the near wake zone, known as base flow or base bleed. This technique is based on that a fuel in the rear part of the projectile generates a mass flow, substantially gaseous, which flows out and usually is made subject to final combustion adjacent to the base plane of the shell/projectile. Utilized types of fuel, having good efficiency and suitable combustion rate (favourable drag reduction during a sufficient part of the flight period for the shell/projectile), are pressure sensitive, and the combustion initiated within the gun barrel by the gun powder gases is usually terminated due to the pressure drop caused when leaving the muzzle of the gun. The course of events can only to a minor extent be reproduced, resulting in an unwanted large dispersion with regard to impact point.

In order to secure reignition of the base bleed fuel, and to receive a reproducable result, a pyrotechnical charge of non-pressure sensitive type is used, known as an igniter. An example of a base bleed unit having such an igniter is disclosed in SE, A, 340 076. Other solutions to the reignition problem are also known, e.g. as disclosed in GB, A, 2 131 926 and DE, A1, 3 246 380, but these are mechanically complicated.

With previously known techniques, it is extremely difficult to change between the base bleed unit and a projectile extension of skirt type, since the utilized igniter is mounted by the base plane of the war head of the shell and with the open part of the igniter directed towards the outlet opening of the base bleed unit. For certain applications, a separate plate including the igniter has been located at the forward end portion of the base bleed unit, but this reduces, at a given total length, the space available for the base bleed charge or "payload" (e.g. explosives).

STATEMENT OF THE INVENTION

The object of the present invention is to disclose a base bleed unit comprising a single and easily replaceable unit, which, when demounted, does not leave any structural elements remaining by the shell body. The shell body does not require machining in order to facilitate attachment of the igniter, and the igniter does thus not require attachment to the shell. The igniter is of an extremely efficient type, having an advantageous location facilitating maximum security for reignition, and smaller and less expensive igniter charges can also be used. The outlet nozzle from the base bleed unit is advantageously in the form of a multi-hole nozzle arrangement with the position of the nozzles arranged to facilitate use of fuel charges having heavy components or additives. The nozzles also improve the efficiency of the unit, i.e. the base drag reducing function of same. The base bleed unit according to the present invention is with regard to manufacture, handling and function considerably improved in relation to previously utilized solutions, and also well adapted for use in combination with ammunition having small calibre, e.g. 30, 40 and 57 mm.

The base bleed unit according to the present invention includes a member attachable by the rear portion of a projectile body, arranged to form a housing in combination with said rear portion surrounding at least one fuel charge and at least one igniter comprising a pyrotechnical charge, and including at least one outlet nozzle by the portion of the housing directed away from the projectile body, said fuel charge being arranged during combustion to generate a mass flow intended to reduce existing base drag, and it is mainly characterised in that igniter or igniters included in the unit are located adjacent to the internal surface of the restricting wall in the housing which is located at a distance from the rear surface of the projectile body.

BRIEF DESCRIPTION OF THE DRAWINGS

A number of examples of embodiments according to the present invention are more fully described below with reference to the accompanying drawings, in which.

DETAILED DESCRIPTION OF THE INVENTION

Figure 1:
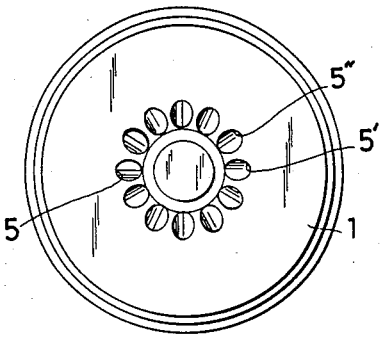
FIG. 1 shows a plan view of the rear plane of a first embodiment of a unit according to the present invention.
Figure 2:
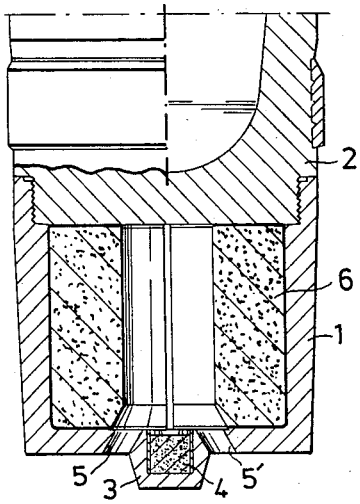
FIG. 2 shows a longitudinal sectional view of the unit which base plane is shown in FIG. 1, mounted to a projectile.

With reference to the embodiment shown in FIGS. 1 and 2, same includes a surrounding housing 1, attached to a projectile body 2 by means of screw thread. The housing 1 has a rear wall located at a distance from the rear plane of the projectile body 2, and said wall includes a centrally located and outwardly extending part 3, in which an igniter 4 is located in a blind hole, open in direction towards the rear plane of the projectile body 2. The rear wall also includes a number of outlet nozzles 5, 5', 5'', located spaced from each other in an annular and surrounding relationship to the igniter 4. A fuel charge 6 is also arranged within the housing 1, and comprising two semi-circular parts in the shown embodiment. The outlet nozzles 5, 5', 5'' are advantageously arranged extending in an inclined relationship to the length axis of the projectile body 2, and with the outer portions located more adjacent to the peripheral part of the housing 1 than the inlets, but the outlet nozzles 5, 5', 5'' can also be arranged extending in a substantially parallel relationship to the length axis of the projectile body 2.

When the projectile is launched, the pyrotechnical charge forming an igniter 4 is ignited, as well as the fuel charge 6, by the combustion flame from the drive charge, which penetrates through the outlet nozzles 5, 5', 5''. Since the igniter 4 is open in direction towards the rear plane of the projectile body 2, the flame from the igniter 4 is directed towards the fuel charge 6, and away from the outlet nozzles 5, 5', 5''. The combustion of the fuel charge 6 is hereby also maintained during the pressure drop occuring when leaving the muzzle of the gun, and in difference to the igniters which previously have been located adjacent to the rear plane of the projectile body 2, having a combustion flame with a substantial part directed out through the outlet nozzle, a considerably improved reignition function is achieved, which results in that combustion of the fuel charge 6 is maintained substantially unchanged also during the pressure drop occuring when leaving the muzzle of the gun. The efficient use of the igniter 4 thus facilitates use of a smaller charge with maintained or improved security.

The outwardly inclined outlet nozzles 5, 5', 5'' makes it possible to obtain a total outlet area of considerable size, but also improved gas flow characteristics adjacent to the base plane, resulting in a further reduction of the base drag in relation to what is accomplished with a base bleed unit having a centrally located outlet nozzle.

By locating the igniter 4 adjacent to the internal surface of the restricting wall of the housing 1, which is located spaced from the projectile body 2, also results in that there is no need for machining the rear plane of the projectile body 2, and it is also obvious that the base bleed unit is easily attached to/removed from the projectile body by means of the screw thread joint. A base bleed unit can thus be easily replaced by, for example, a projectile extension, and it can easily be removed and remounted in connection with revision of the base bleed unit, i.e. when replacing the igniter 4 and the fuel charge 6 of the unit. Such a revision is further simplified by the fact that the housing 1, when demounted, facilitates free access to both the fuel charge 6 and the igniter 4 from the end portion which is intended to be attached against a projectile body 2.

Figure 3:
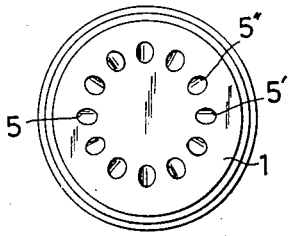
FIG. 3 shows a plan view corresponding to FIG. 1 of a second embodiment of a unit according to the present invention.
Figure 4:
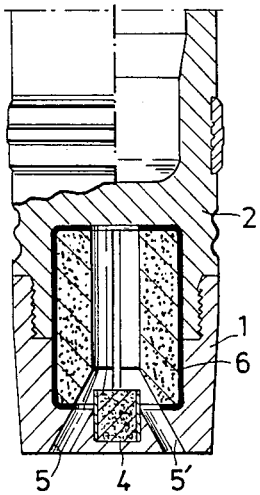
FIG. 4 shows a sectional view corresponding to FIG. 2 of the second embodiment.

FIGS. 3 and 4 show an example of a second embodiment of a replaceable unit according to the invention, with the rear wall portion of the housing 1 having such a thickness, that no outwardly extending part 3 is required to facilitate attachment of the igniter 4. For many applications, such an outwardly extending part 3 is less desirable, and it may thus be avoided by increasing the rear wall thickness of the housing 1. It is also shown in this embodiment, how an existing recess in the rear plane of the projectile body 2 can be used to surround part of the fuel charge 6, and how the total length extension of the housing 1 thereby can be reduced.

Figure 5:
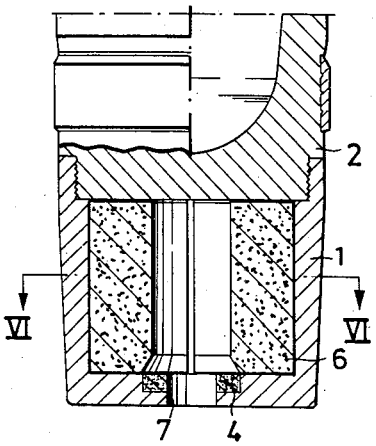
FIG. 5 shows a longitudinal sectional view corresponding to FIGS. 2 and 4 of a third embodiment according to the present invention.
Figure 6:
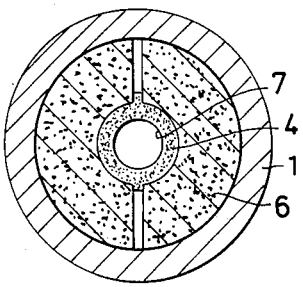
FIG. 6 shows a cross-sectional view at the sectional line VI—VI in FIG. 5.

As previously mentioned, it is preferred to use a number of spaced outlet nozzles 5, 5', 5'', inclined towards the peripheral portion of the housing 1, but for certain applications, a centrally located outlet nozzle 7 is also acceptable. FIGS. 5 and 6 show an example of such an embodiment, in which the centrally located outlet nozzle 7 by the portion directed towards the fuel charge 6 is arranged with an annular groove, in which an annular igniter 4 is located.

Figure 7:
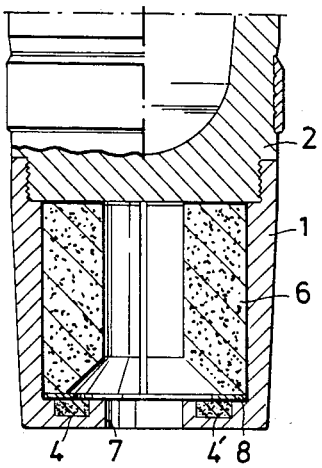
FIG. 7 shows a longitudinal sectional view corresponding to FIGS. 2, 4 and 5 of a fourth embodiment according to the present invention.
Figure 8:
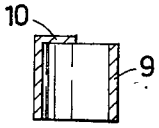
FIG. 8 shows a longitudinal sectional view of a tubular member, which can be used as a tube partly surrounding an igniter.

A further alternative embodiment having a centrally located outlet nozzle 7 is shown in FIG. 7, in which the centrally located igniter 4 of the previous embodiment is replaced by a number of igniters 4, 4', for example four individual ones, located spaced from each other in blind holes taken from the inside plane of the rear wall of the housing 1. The surface of the pyrotechnical charge of each igniter 4, 4', which is directed towards the fuel charge 6, can advantageously be arranged partly covered, which in this embodiment is illustrated by a washer-shaped member 8, having a hole diameter causing at least the outer part of each igniter 4, 4' being covered. Such a restriction of the open surface of each igniter 4, 4' results in that the combustion flame is "directed" towards the opposed surface of the fuel charge 6, but also improves the support for the fuel charge 6 against the acceleration forces applied during launch. It is also possible to use other methods to make the part of the igniter 4, 4' directed towards the fuel charge 6 to become partly covered, e.g. by locating the pyrotechnical charge constituting an igniter 4, 4' in a surrounding tubular member 9, which includes a partly covering lidshaped member 10 by one end portion, and an example of such a surrounding tubular member 9 is shown in FIG. 8.

Figure 9:
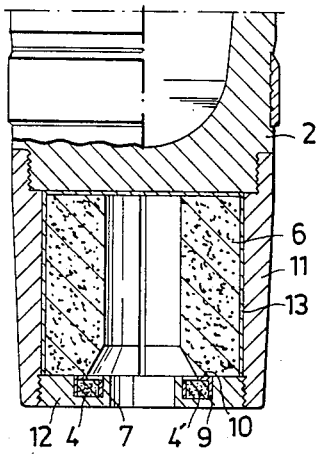
FIG. 9 shows a longitudinal sectional view corresponding to FIGS. 2, 4, 5 and 7 of a fifth embodiment according to the present invention.

For certain types of projectiles, a rearwardly open projectile extension is used, known as a skirt, and such an extension may comprise of a member integrated with the projectile body 2, but may also be a tubular member 11 attached to the projectile body 2, e.g. attached by means of a screw thread. This type of projectiles can advantageously be used with a base bleed unit according to the present invention, which to some extent is indicated in FIG. 4, but which is further emphasized by the embodiment shown in FIG. 9. According to this embodiment, the projectile body 2 is arranged with a rearwardly open projectile extension 11, which by the internal free edge portion is arranged with a screw thread, against which a bottom member 12 is attached, in which igniters 4, 4' having surrounding tubular members according to FIG. 8 have been choosen to exemplify an igniter arrangement, and with a centrally located outlet nozzle 7 choosen as an example of a nozzle arrangement. The bleed unit thus comprises only of the bottom member 12 and therein arranged igniters 4, 4', and the fuel charge 6, while a surrounding housing for the fuel charge 6 is accomplished by using the projectile body 2 with associated projectile extension 11. The fuel charge 6 with associated bottom member 12, and therein arranged igniters 4, 4', are advantageously arranged protected and joined into one unit by means of a protective cover 13 surrounding the fuel charge 6, e.g. of metal or synthetic plastics, attached to the bottom member 12, and such a unit can be handled as an easily replaceable unit, which can be easily stored, transported and mounted or demounted.

Previously existing problems with the large forces imposed on an igniter 4, 4' during acceleration in a gun barrel are also substantially eliminated by the present invention. By the proposed location, the igniter charge is heavily supported on all sides subjected to acceleration forces, whereby the risk for cracking, or that it may completely fall out, must be regarded as non-existent. In previously known solutions, there is a contradiction between the demand for support and free combustion surface, but this contradiction is completely eliminated according to the present invention. A larger combustion surface can thus now be achieved, and the requirements relating to physical properties of the igniter charge are reduced, as well as the required pressure applied during manufacture. As a result, there are now favourable conditions for influencing, for example, the combustion rate of the igniter 4, 4'. Each igniter 4, 4' includes advantageously a surrounding tubular member, preferably open at both end portions. When same has been filled with a suitable pyrotechnical charge, it can be attached to intended blind hole by means of a gluing method, or by choosing the tolerance between the outer diameter of the tubular member and the diameter of the blind hole in such a fashion, that a press fit is accomplished therebetween. For certain applications, the igniter charge may also be pressed directly into intended space by the rear wall of the housing 1.

As previously mentioned, a multi-hole outlet nozzle arrangement is preferred, but also other arrangements may be used. In a multi-hole outlet nozzle arrangement it is preferred to arrange the outlet nozzles 5, 5', 5'' with an inclined extension, as shown in FIGS. 2 and 4, but also outlet nozzles having a substantially perpendicular line of extension in relation to the base plane of the housing 1 can be used.

The present invention thus results in substantial advantages in relation to previously known types of base bleed units, and facilitates simple modification of existing shells and projectiles for use in combination with a base bleed unit. Furthermore, it is also considerably easier to accomplish base bleed for ammunition having small calibre, e.g. 30, 40 and 57 mm.

Shown and described examples of embodiments can be combined in various ways, and also be further modified within the scope of the inventive thought and the following claims, and should in no way be regarded as restricting examples of embodiments according to the invention. A multi-hole outlet nozzle arrangement may thus include a substantially centrally located outlet nozzle 7, surrounding by from each other spaced outlet nozzles 5, 5', 5''.

We claim:

1. A base bleed unit, comprising:

a fuel charge;

an igniter associated with said fuel charge;

a member attachable to a rear portion of a projectile body, arranged to form a housing in combination with said rear portion surrounding said fuel charge and said igniter, and including at least one outlet nozzle at a portion of the housing directed away from the projectile body, said outlet nozzle providing an open passage permitting communication from outside said housing to said igniter, said member including a restricting wall located at a distance from said rear portion, said fuel charge being arranged during combustion to generate a mass flow intended to reduce existing base drag, said igniter being included in the member and located adjacent to an internal surface of the restricting wall;

said igniter being located within said housing to be ignitable by combustion of a driving charge from outside said housing communicating with said igniter via said open passage provided by said outlet nozzle, whereby upon ignition said igniter provides a flame directed toward said fuel charge and away from said outlet nozzle.

2. A base bleed unit according to claim 1, characterised in, that the housing is open to said rear portion to be attached to a projectile body.

3. A base bleed unit according to claim 1, characterised in, that the housing comprises a projectile extension from the projectile body, open in a direction away from the projectile body, and a bottom member attachable against the open portion to form said restriction wall, said bottom member including at least one said outlet nozzle and at least one said igniter.

4. A base bleed unit according to claim 2, characterised in, that the restricting wall of the housing, is located at the end portion of the housing directed away from the projectile body, is arranged having a number of outlet nozzles located in an annular configuration and preferably having the outlet openings located more adjacent to the peripheral part of the housing than the inlet openings, said restricting wall being arranged having at least one recess, preferably centrally located and open in direction towards the projectile body, surrounding a pyrotechnical charge forming an igniter.

5. A base bleed unit according to claim 2, characterised in, that the restricting wall of the housing directed away from the projectile body, is arranged with preferably substantially centrally located outlet nozzle, preferably with a portion of the outlet nozzle located adjacent to the plane of the restricting wall directed towards the projectile body being arranged as a recess having an enlarged diameter, arranged surrounding a preferably annular pyrotechnical charge forming an igniter.

6. A base bleed unit according to claim 2, characterised in, that the restricting wall of the housing is located at an end portion of the housing spaced apart from the projectile body, is arranged with a hole open in a direction towards the projectile body and contains a pyrotechnical charge forming an igniter.

7. Base bleed unit according to claim 2, characterised in, that the restricting wall (12) of the housing (1; 11, 12), which is located at the end portion of the housing (1; 11, 12) directed away from the projectile body (2), is arranged with one or a number of parts (3) extending from its outer plane, arranged surrounding a recess or blind hole for an igniter (4).

8. A base bleed unit according to claim 2, characterised in, that a tubular member having open end portions, is arranged surrounding the pyrotechnical charge forming an igniter, and said tubular member is attachable in a recess in the restricting wall.

9. A base bleed unit according to claim 2, characterised in, that an area restricting means is arranged to partly cover an end portion of an igniter open in a direction towards said projectile body.

10. A base bleed unit according to claim 2, characterized in that the outlet nozzles are arranged in a configuration including a substantially centrally located outlet nozzle surrounded by and spaced apart from other outlet nozzles.

11. A housing of a base bleed unit of a projectile comprising:

a peripheral member attachable to a rear portion of a projectile body, providing in combination with the rear portion, a chamber capable of containing a fuel charge; and a rear wall joined to said peripheral member, having an interior surface forming one end of said chamber spaced apart by said peripheral member from the projectile body;

said interior surface including means for containing and for exposing an igniter to a fuel charge containable within said chamber;

said rear wall including an open nozzle communicating from outside said peripheral member to within said peripheral member and enabling a drive charge outside said peripheral member to communicate via said nozzle with an igniter contained within said containing means and with a fuel charge within said chamber.

12. The base bleed unit housing of claim 11, further comprised of said containing means being oriented to hold an igniter in coaxial disposition with a longitudinal axis of said peripheral member and with the igniter directed toward a fuel charge positionable within said chamber.

13. The base bleed unit housing of claim 11, further comprised of said chamber, when containing a fuel charge, providing a passage open in direction between said containing means and the rear portion enabling direct communication between an igniter within said containing means and a fuel charge positioned within said chamber.

14. The base bleed unit housing of claim 12, further comprised of said chamber, when containing a fuel charge, providing a passage open in direction between said containing means and the rear portion enabling direct communication between an igniter within said containing means and a fuel charge positioned within said chamber.

15. The base bleed unit housing of claim 11, further comprised of said nozzle comprising one of a plurality of nozzles communicating from outside said peripheral member to within said peripheral member and enabling a drive charge outside said peripheral member to communicate via said nozzles with an igniter within said containing means and with a fuel charge within said chamber.

16. The base bleed unit housing a claim 12, further comprised of said nozzle comprising one of a plurality of nozzles communicating from outside said peripheral member to within said peripheral member and enabling a drive charge outside said peripheral member to communicate via said nozzles with an igniter within said containing means and with a fuel charge within said chamber.

17. The base bleed unit housing of claim 13, further comprised of said nozzle comprising one of a plurality of nozzles communicating from outside said peripheral member to within said peripheral member and enabling a drive charge outside said peripheral member to communicate via said nozzles with an igniter within said containing means and with a fuel charge within said chamber.

18. The base bleed unit of claim 15, further comprised of said nozzles being inclined to intersect a longitudinal axis of said chamber, within said chamber.

19. The base bleed unit housing of claim 11, further comprising a tubular member having open base portions, disposed within said containing means to surround an igniter contained within said containing means while exposing the igniter to a fuel charge containable within said chamber.

20. The base bleed unit housing of claim 11, further comprising area restricting means arrangeable for partly covering an end portion of an igniter contained within said containing means while exposing the igniter to a fuel charge containable within said chamber.

21. A housing of a base bleed unit of a projectile, comprising:

a peripheral member attachable to a rear portion of a projectile body, providing in combination with the rear portion, a chamber capable of surrounding and containing a fuel charge positioned within said chamber as an annular cylinder containing a lumen symmetrically disposed relative to a longitudinal axis of said peripheral member;

a rear wall joined to said peripheral member, having an interior surface forming one end of said chamber spaced apart by said peripheral member from the projectile body;

said interior surface including means for containing and for exposing an igniter spaced apart opposite from said rear portion by said chamber and the lumen to a fuel charge containable within said chamber;

said rear wall including an open nozzle communicating from outside said peripheral member to within aid peripheral member and enabling a source of combustion outside said peripheral member to communicate via said nozzle with an igniter contained within said containing means.

22. The base bleed unit housing of claim 21, further comprised of said containing means being oriented to hold an igniter in coaxial disposition with a longitudinal axis of said peripheral member and with the igniter directed toward a fuel charge positionable within said chamber.

23. The base bleed unit housing of claim 21, further comprised of said chamber, when containing a fuel charge, providing a passage open in direction between said containing means and the rear portion enabling direct communication between an igniter within said containing means and a fuel charge positioned within said chamber.

24. The base bleed unit housing of claim 21, further comprised of said nozzle comprising one of a plurality of nozzles communicating from outside said peripheral member to within said peripheral member and enabling a drive charge outside said peripheral member to communicate via said nozzles with an igniter within said containing means and with a fuel charge within said chamber.

25. The base bleed unit housing of claim 21, further comprising a tubular member having open base portions, disposed within said containing means to surround an igniter contained within said containing means while exposing the igniter to a fuel charge containable within said chamber.

26. The base bleed unit housing of claim 21, further comprising area restricting means arrangeable for partly covering an end portion of an igniter contained within said containing means while exposing the igniter to a fuel charge containable within said chamber.

* * * * *